United States Patent [19]

Cheng

[11] Patent Number: 4,995,615

[45] Date of Patent: Feb. 26, 1991

[54] METHOD AND APPARATUS FOR PERFORMING FAIR CARD PLAY

[76] Inventor: Kuan H. Cheng, 7F-1, No. 50, Hou Lung Street, Taichung City, Taiwan

[21] Appl. No.: 377,072

[22] Filed: Jul. 10, 1989

[51] Int. Cl.[5] ..... A63F 1/00; A63F 9/22

[52] U.S. Cl. ..... 273/292; 273/85 CP; 273/138 A

[58] Field of Search ..... 273/85 CP, 138 A, 292; 271/266; 400/642, 624

[56] References Cited

U.S. PATENT DOCUMENTS

| | | | |
|---|---|---|---|
| 4,560,161 | 12/1985 | Hamano | 273/85 CP |
| 4,614,342 | 10/1986 | Takashima | 273/138 A |
| 4,678,178 | 7/1987 | Akiyama et al. | 271/266 |
| 4,760,527 | 7/1988 | Sidley | 273/85 CP |
| 4,810,120 | 3/1989 | Narita et al. | 400/624 |

*Primary Examiner*—Edward M. Coven
*Assistant Examiner*—Jessica J. Harrison
*Attorney, Agent, or Firm*—Connolly and Hutz

[57] ABSTRACT

A method for achieving fair card games including the steps of: randomly generating distinct numbers corresponding to each one of the cards employed for the card games; printing out the sequence of the predetermined distinct number on a sheet which is covered so as not to be visible by players before and during processing of the play; displaying sequentially the cards being distributed or drawn throughout the processing of the card games; and sending out the sheet with a sequence of the randomly generated numbers printed on it and comparing to the displayed sequence after the card game is over. The apparatus for playing fair card games comprises a registering and printing device designed to cooperate with a printer for sending out the sheet. The registering and printing device includes a curved double-layer plate which is composed of a transparent upper layer and an opaque lower layer. A gap is formed between the two layers for carrying and conveying the sheet. An opaque board is further provided to cover a portion of the double-layer plate so that the sheet is temporarily invisible.

3 Claims, 4 Drawing Sheets

METHOD AND APPARATUS FOR PERFORMING FAIR CARD PLAY

BACKGROUND OF THE INVENTION

The present invention relates to a method and apparatus for performing a fair card play in which the shuffling and distribution of cards can be effectuated by computer. A printout of a pre-determined sequence corresponding to the well-shuffled deck is made prior to the play of game, and is concealed from the players to prohibit intentional cheating. The method and apparatus can therefore be used to ensure fair play.

Games of chance are often based on the assumption of the equal likelihood of events. If a card is picked from a deck, most would say that one card, for example the three of clubs, is just as likely to be chosen as any other card, such as the eight of diamonds. Experience has shown that actually all cards are equally likely to be chosen from a well shuffled deck, so that the assumption of equal likelihood holds.

Card games based on electronic devices are widely known. During the processing of these games, each of the processing steps is monitored by computer programs which can be designed to favor the computer itself. Therefore, a really fair game cannot be achieved from the players' viewpoint.

In the hand shuffling or manual distribution of cards, unfair play is even more likely to occur by intentional cheating or unavoidable error. Take black jack, a card game also known as twenty-one, for example. It is played with a standard deck, by two or more persons, against a dealer (banker). The object is to obtain a hand counting equal to or over 17 and preferably 21, or as close as possible to 21 without going over. Aces count 1 or 11, face cards 10, and other cards their face value. To begin with, each player is dealt one card face down and makes his bet. He then receives a card face up. He may "hold" with two cards or draw more, one at a time. If he goes over 21, he pays the dealer. The dealer draws last and only loses to hands closer to 21 than his own. Two cards totaling 21 form a "natural", or "blackjack", for which the dealer either collects or pays double.

From the above description, it will therefore be readily acknowledged that the manual shuffling, distribution, and drawing of cards inevitably leave the game open to intentional cheating or unintentional error making black jack and similar games of chance inherently unfair. During actual playing with cards, in order to obviate the above unfairness, usually the presumably well-shuffled deck or cards are placed on for example a table instead of being held by the dealer so that players can clearly observe the cards throughout the play process. However, as long as the cards per se are utilized, a certain form of cheating like cooperation between the dealer and one of the players is possible with regard to intentional cheating, such that a fair card game may not be achieved (or at least a player can never be sure that the card game in which he is participating is fair).

SUMMARY OF THE INVENTION

According to this invention there is provided a method for performing a fair card play comprising the steps of utilizing randomly generated distinct numbers of codes representing each of the cards for this card game by a computer, printing out the generated and predetermined distinct number in sequence corresponding to a sequence to be played through on a sheet which is concealed from the players before and during the play, displaying sequentially the cards being distributed or used throughout the processing of the play on displaying devices, and sending out the sheet with the sequence of the cards printed thereon for comparing with the displayed sequence after the card game is over. By this method, a fair card play can be achieved, and therefore each player can be assured to the fairness of the card game.

According to this invention an apparatus for performing the above method therefore comprises a registering and printing device such as a printer for printing the sequence of the cards before the game starts and sending out a sheet with the sequence of the cards printed thereon.

DETAILED DESCRIPTION OF THE PREFERRED EMBODIMENT

The method of this invention for playing fair card games will now be described by way of referencing a specific kind of card game, i.e., black jack, also known as twenty-one, which is well-known as well as easy to play. The game black jack has particularly been chosen as a means through which the claimed method of the present invention will be disclosed with clarity hereinafter because black jack, rather than requiring any skill, depends entirely on the card sequence.

The word "fair", as referenced to herein, means that all cards (one or more decks) employed in the card games are equally likely to be chosen so that the assumption of equal likelihood for computing probabilities is valid. Further, it means that the cards employed in the card games form a randomly determined., well-shuffled deck. Most importantly, it means that the card sequence of the above deck cannot be changed during the play process so that intentional cheating is not possible. In a wider sense, it means that the deck is not shuffled manually so that a random sequence of cards that no player can anticipate is obtained. In the present invention, real cards need not be utilized and the randomly determined sequence of the cards is easily done through a computer in a known way, in which the above sequence can be ascertained or checked if so desired, but unaltered by a printout concealed before the beginning of play as well as during the play of game.

Figure 1:
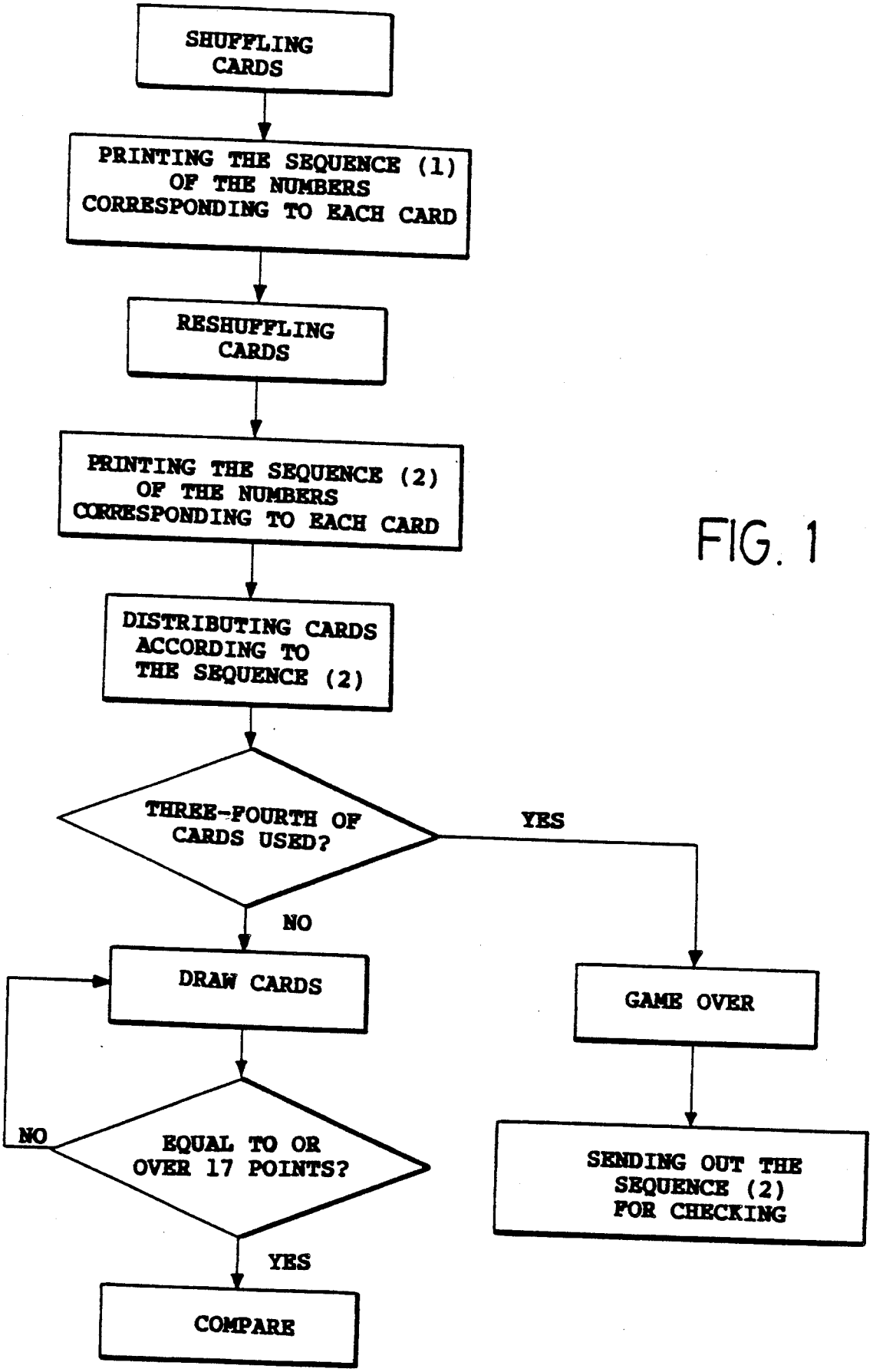
FIG. 1 is a flow chart illustrating a method, by way of playing the card game "black jack", a method for performing a fair card game in accordance with the present invention.

Referring now to the drawings, and more particularly to FIG. 1, there is shown the flow chart, which substantially illustrates the steps of this invention for playing black jack. The steps for achieving a fair card game in this embodiment, comprises firstly generating randomly distinct numbers representing each of the cards employed for this card game as by a computer (not shown) ; i.e., shuffling the cards. The sequence (sequence (1) in FIG. 1) of the determined distinct numbers corresponding to each card is then printed out on a sheet which is covered so that it is concealed from the players beforehand during play. The devise for carrying and conveying the sheet such that the sheet can be temporarily unseen will be described hereinbelow.

After the sequence of the cards has been determined and printed out, any player can ask to reshuffle the cards any number of times based on the above-determined sequence. This process may be necessary because, through reshuffling, the above temporarily determined sequence of the cards will not be known to any player even in the case that the sequence (1) might be anticipated. For example, the random production of cards unfortunately may have been devised in a way that could be anticipated. The last sequence (represented by sequence (2)) of the cards is then printed on the sheet and this sequence (2) is believed to be well-shuffled.

The card game can now be played on. The cards are distributed to player(s) and played based on known rules, such as those described hereinbefore which do not form a part of the method of this invention but are only for purposes of illustration for playing black jack. Throughout the play of game, each distributed or drawn card is displayed sequentially on monitors, shown in FIG. 2. The construction of the monitors is conventional and does not play a part of the present invention. The monitors utilized in this invention comprise monitors 11 for displaying used cards sequentially, a monitor 13 for displaying the stock and the waste pile of the dealer, and respective monitor 12 for each player except the dealer. It is also noted that buttons 14 capable of inputting pre-designed functions like double, split, insurance, abandon, push or win to instruct the computer, can be suitably incorporated therein, but since these functions are available in the art, they will not be further described here. Also, the buttons and known functions do not play a part of this invention.

From the above description, it can be understood that the card game is played with each already used card displayed on the monitor 11. When approximately three-fourths ($\frac{3}{4}$) of the cards have been used, as is generally required when playing actual cards, the game is over and the rest of the cards will all be sequentially displayed on the monitor 11. At this moment, the sheet which has both the sequence of the determined distinct numbers and the above-mentioned last sequence (2) printed thereon is sent out to be further compared with the sequence of the cards displayed on the monitor 11 to check whether both are the same. As can be realized, the above-mentioned last sequence (2) on the sheet should be the same as the sequence of the cards displayed on the monitor 11 according to the method of this invention. Furthermore, the sequences of the determined distinct numbers and the above-mentioned last sequence (2) should also be the same except for shifts resulting in shuffling cards.

Figure 2:
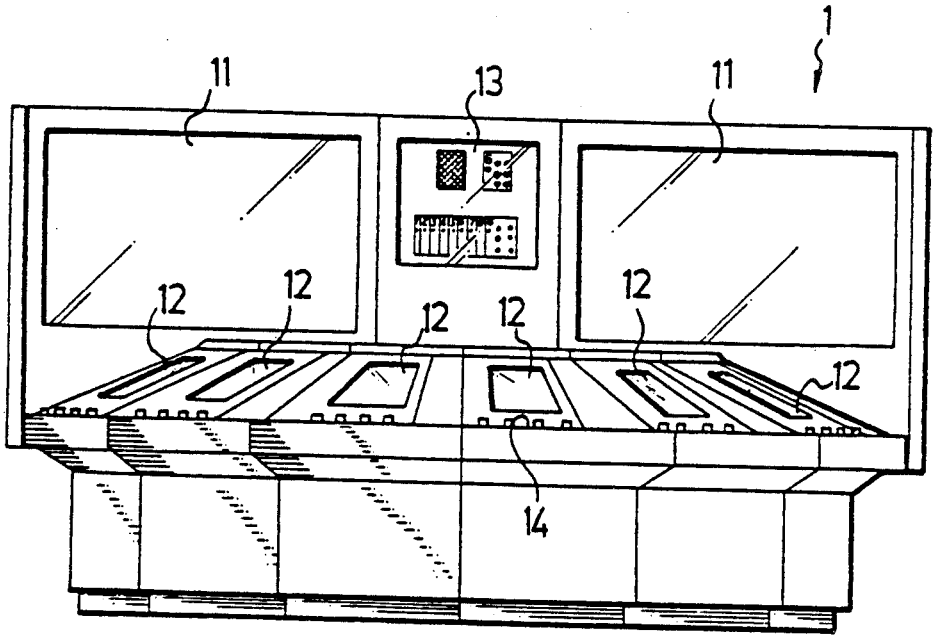
FIG. 2 is a front perspective view showing the general construction, particularly the monitors, of an apparatus for performing fair card play in accordance with the present invention.
Figure 3:
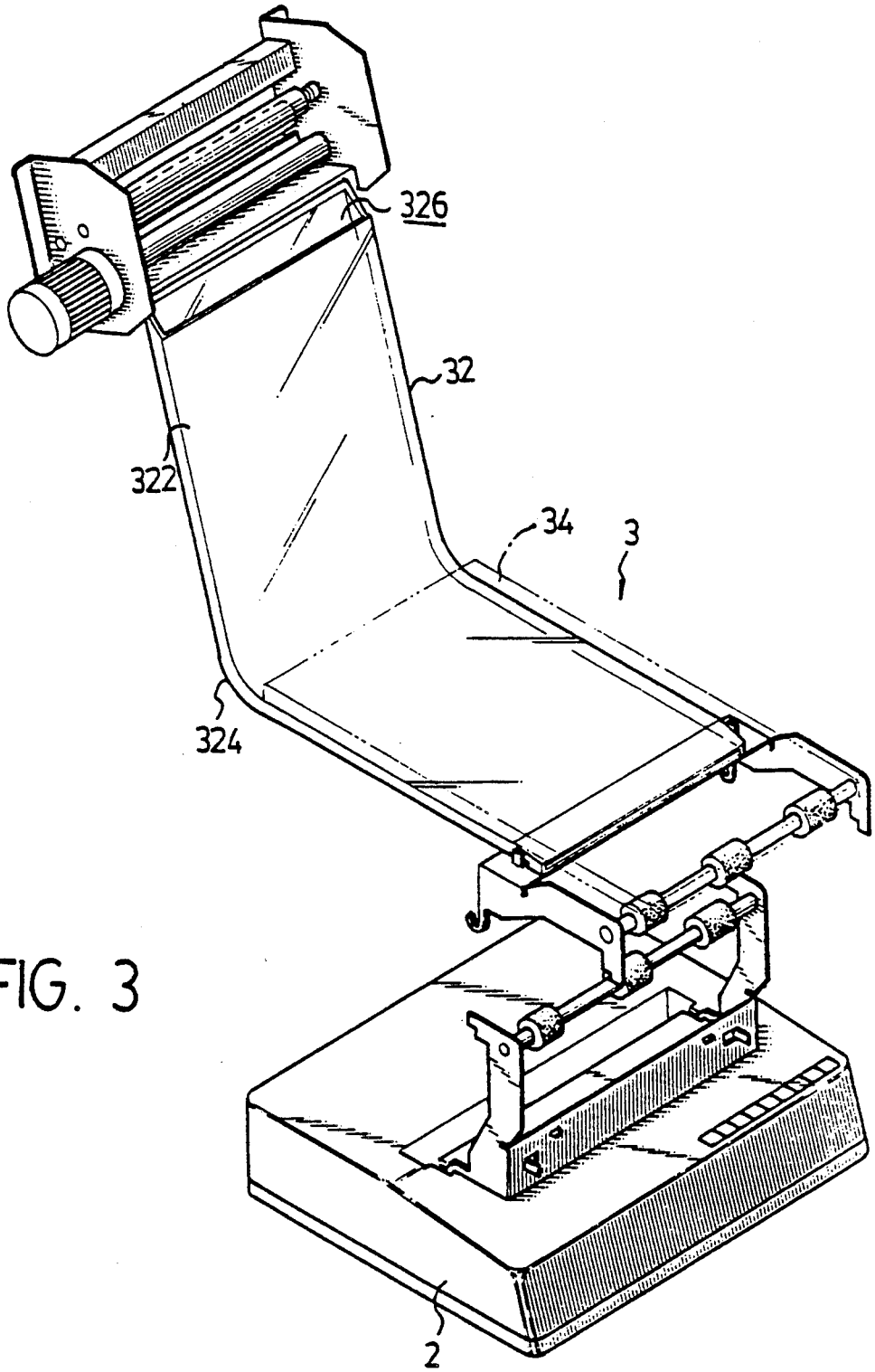
FIG. 3 is a perspective view of the registering and printing device in accordance with the apparatus of the present invention.
Figure 4:
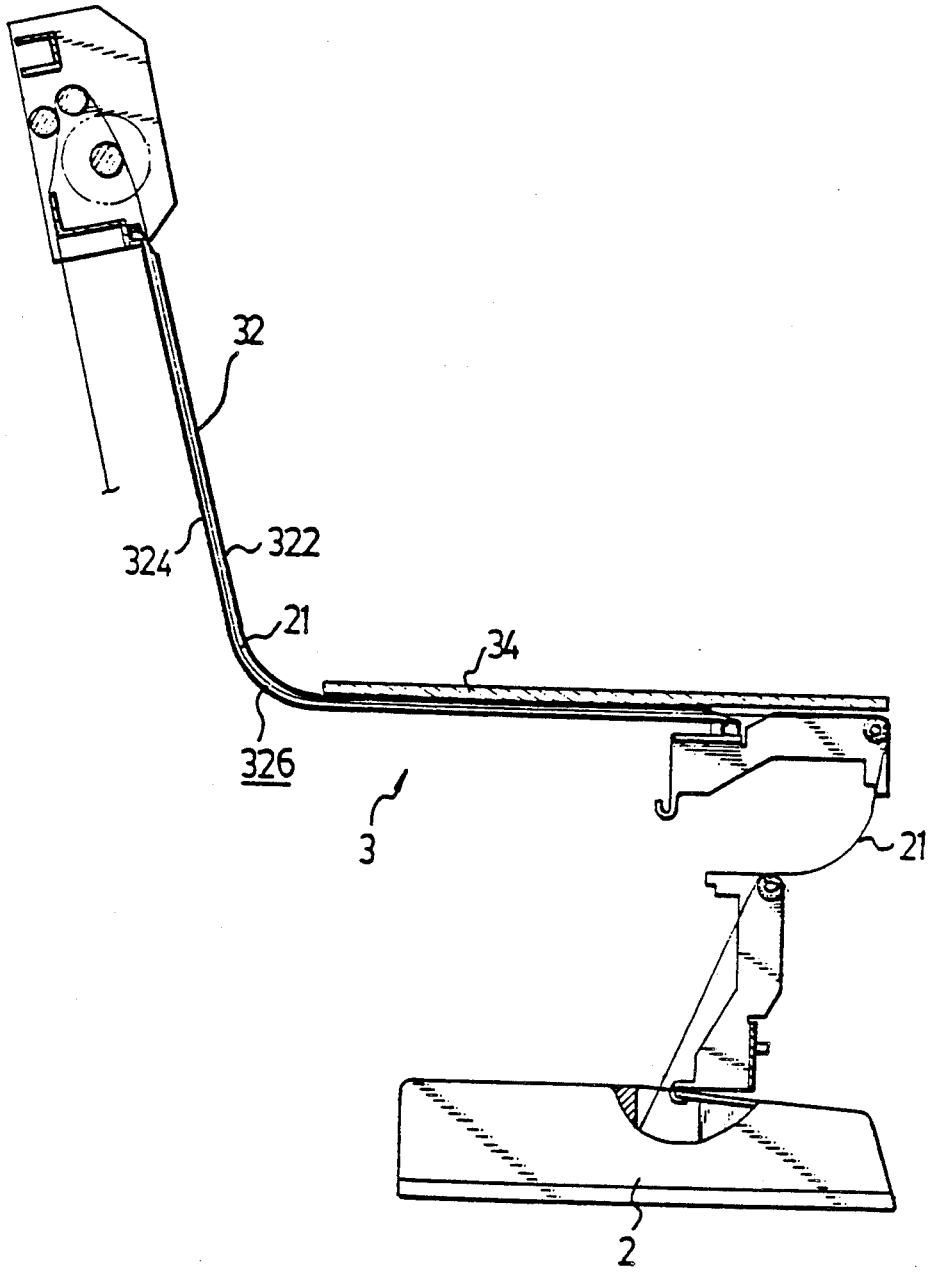
FIG. 4 is a side cross-sectional view of FIG. 3.

The apparatus for playing card games in a fair way therefore comprises a component capable of randomly generating distinct numbers each corresponding to one of the cards employed for the concerned card game, monitors 11, 12, 13 capable of receiving instructions from the computer to display sequentially the cards being distributed throughout the processing of the play, and a registering and printing device designed to send out the sheet with the sequence of the distinct numbers printed thereon, as shown in FIGS. 2 to 4.

FIG. 3 shows the registering and printing device 3 in cooperation with a printer 2. The registering and printing device 3 comprises a substantially curved double-layer plate 32 of a suitable width. The plate 32 is composed of a transparent upper layer 322 and an opaque lower layer 324 forming a gap 326 there between for carrying and conveying the sheet 21 (shown in FIG. 4). An opaque board 34 is provided to cover a portion of the plate 32 such that the sheet with the card sequence printed thereon is concealed from the players. The registering and printing device 3 has a number of other elements, such as rollers, linking and supporting frames, constructed to assist in carrying and conveying the sheet 21, but these do not constitute a part of this invention.

From the above description, it can be realized that the movements of the dealer are entirely replaced by the apparatus of this invention in an absolutely fair way. The method of this invention can be utilized in playing other card games in addition to black jack to achieve a fair play. Therefore, it is to be understood that the invention disclosed herein as intended to cover all variations as fall within the scope of the appended claims.

I claim:

1. A method for playing a card game involving the random production of cards in a single sequence, wherein all the cards in the sequence are equally likely to be produced so that an assumption of equal likelihood for computing probabilities is valid, said method comprising the steps of: (a) printing out a single random sequence of the cards on a sheet on which the sequence is covered so as not to be visible by players before and during the play; (b) completing the play of the cards by producing them one at a time in the foregoing sequence; and (c) after the play is completed, uncovering the printed sequence so that it can be compared with the produced sequence.

2. The method of claim 1 in which the card game is black jack.

3. The method of claim 1 in which the sequence is re-shuffled and the printout follows the last re-shuffle.

* * * * *